US006891122B2

(12) United States Patent
Renz

(10) Patent No.: US 6,891,122 B2
(45) Date of Patent: May 10, 2005

(54) VACUUM SWITCH TUBES

(75) Inventor: Roman Renz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/311,254

(22) PCT Filed: Jun. 8, 2001

(86) PCT No.: PCT/DE01/02187

§ 371 (c)(1),
(2), (4) Date: Dec. 13, 2002

(87) PCT Pub. No.: WO01/97242

PCT Pub. Date: Dec. 20, 2001

(65) Prior Publication Data

US 2003/0141282 A1 Jul. 31, 2003

(30) Foreign Application Priority Data

Jun. 16, 2000 (DE) ..... 100 29 763

(51) Int. Cl.[7] ..... H01H 33/66
(52) U.S. Cl. ..... 218/136; 218/118; 218/11
(58) Field of Search ..... 218/118–135, 136–138, 218/77, 147, 10, 11

(56) References Cited

U.S. PATENT DOCUMENTS 3,185,797 A * 5/1965 Porter ..... 218/126
3,185,800 A * 5/1965 Titus ..... 218/136
3,792,214 A 2/1974 Voshall
3,903,386 A * 9/1975 Yangisawa ..... 218/136
4,006,331 A * 2/1977 Crouch ..... 218/136
4,135,071 A * 1/1979 Crouch ..... 200/275
4,361,742 A * 11/1982 Kashiwagi et al. ..... 218/136
4,620,074 A 10/1986 Paul et al.
5,313,030 A * 5/1994 Kusserow et al. ..... 218/136

FOREIGN PATENT DOCUMENTS

DE 197 13 478 C1 4/1998
EP 0 155 376 A1 9/1985
GB 2 055 250 A 2/1981

OTHER PUBLICATIONS

IEEE Transaction on Power Apparatus and Systems, vol. PAS–99, No. 2, Mar./Apr. 1980, pp. 658–666.

* cited by examiner

*Primary Examiner*—Elvin Enad
*Assistant Examiner*—M. Fishman
(74) *Attorney, Agent, or Firm*—Morrison & Foerster LLP

(57) ABSTRACT

On both sides of a metal switching chamber, the novel vacuum switch tubes are respectively provided with two ceramic insulators which have the same diameter. Axially interspaced cylindrical vapor shields are fixed to the wing parts of said components. The easy to produce low-volume structure means that is possible to control operating voltages of more than 60 kV.

9 Claims, 1 Drawing Sheet

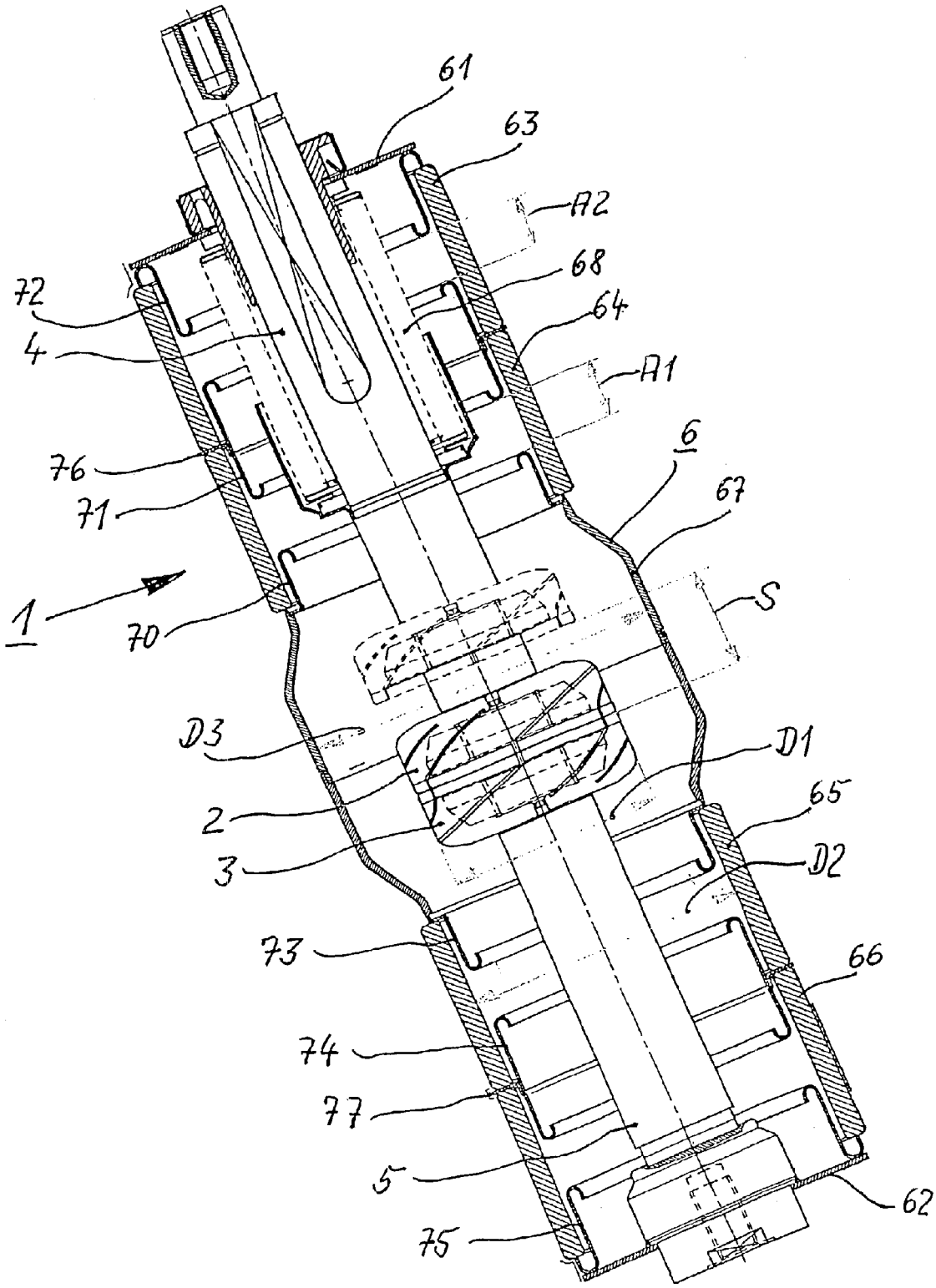
61
63
A2
68
72
64
4
A1
6
76
67
71
S
1
70
D3
D1
65
2
3
D2
73
66
74
77
5
62
75

VACUUM SWITCH TUBES

The invention relates to the field of electrical switches and can be applied in the design embodiment of a vacuum switch tube, the housing of which encompasses two contact pieces, which are movable relative to one another, and which has two ceramic insulators of the same diameter arranged coaxially to one another, the two ceramic insulators being joined to one another in a vacuum-tight manner by means of a metal piece inserted between them and in the form of a switching chamber.

In a known vacuum switch tube of this kind, the contact pieces are so-called axial magnetic field contacts in the form of a cup, each provided with a current feed bolt and axially movable relative to one another through a specified switching travel. At the same time, each current feed bolt is encompassed by one of the two ceramic insulators, and cylindrical vapor shields are fixed to the metal piece joining the ceramic insulators. This design of vacuum switch tubes makes it possible to make the inside diameter of the ceramic insulators smaller than the inside diameter of the switching chamber even for large diameters of the contact pieces. In this case, it is expedient to design the switching chamber to be axially divided.—A vacuum switch tube of this kind is especially suitable for use in switching systems at the medium voltage level (15 to 36 kV) (DE 197 13 478 C1).

Against the background of a vacuum switch tube with the characteristics of the precharacterizing clause of patent claim 1, the invention is based on the object of designing the vacuum switch tube so that it can also be used for high voltage purposes, i.e. for operating voltages of more than 60 kV (e.g. 72 kV, 84 kV). This object is achieved, according to the invention, in that both the first and the second ceramic insulator each has associated with it a further, similar ceramic insulator coaxial and immediately adjacent to it, the two adjacent ceramic insulators each being joined to one another in a vacuum-tight manner by means of a metal piece inserted between them, in that, furthermore, a cylindrical vapor shield is fixed to each of the inserted metal pieces and in that all vapor shields are arranged at an axial distance from one another.

A vacuum switch tube of this kind is distinguished by the necessary dielectric strength being achieved with a very small physical volume and it being possible to make it using the normal manufacturing facilities for medium voltage tubes. By designing all the vapor shields with a cylindrical shape and due to their axially staggered arrangement, the diameter of all the ceramic insulators can be chosen to be relatively small and is about 130 mm for a 72 kV tube. The necessary widening of the vacuum switch tube in the area of the actual switching gap has no effect on the diameter of the ceramic insulators, as a metallic switching chamber, expediently made of copper, is used in this area. This may have a belly shape so that it can be joined in a vacuum-tight manner at its edges to the adjacent ceramic insulators in spite of their smaller diameter.

For the operation of the vacuum switch tube and with regard to the costs incurred for ceramic insulators of larger diameter, it is advantageous if the inside diameter of all the ceramic insulators is at the most equal to the outside diameter of the contact pieces plus the switching travel and if the inside diameter of the metal piece, which is in the form of a switching chamber, is at the most equal to the outside diameter of the contact pieces plus twice the switching travel. At the same time, the relatively small diameter of the switching chamber is made possible by the use of axial magnetic field contacts for the contact pieces.

If it is intended that the new vacuum switch tube should have the capability to be used for higher voltages than 72 kV, the tube can be increased in length by the coaxial arrangement of further similar ceramic insulators and the insertion of a metal piece carrying a cylindrical vapor shield between each.

Vacuum switch tubes with four coaxially arranged ceramic insulators and metal parts inserted between them as well as with vapor shields fixed to the metal parts are known per se. With a known tube of this kind used in the medium voltage range (34 kV), the vapor shields are designed to be conical and overlap one another in the axial direction of the tube. As a result, the ceramic insulators have a relatively large diameter (U.S. Pat. No. 3,792,214 A).—The use of a vapor shielding system formed by three shields, which are at a floating potential, in a high voltage vacuum switch tube (72 kV) has also become known. Here, spiral electrodes, if necessary with the additional use of an external magnet coil, were used for the contact pieces. With a vacuum switch tube of this kind, the ceramic insulators have a relatively large diameter of 230 mm (IEEE Transactions on Power Apparatus and Systems Journal, Vol. PAS-99, No. 2 March/April 1980, Pages 658 to 666).

An exemplary embodiment of the new vacuum switch tube is shown in the single FIGURE of the drawing.

The vacuum switch tube 1 shown in the FIGURE has a contact arrangement which comprises the axially movable contact piece 2 and the fixed contact piece 3, these contact pieces being provided with current feed bolts 4 and 5 respectively. The contact pieces 2 and 3 are in the form of cup-shaped axial magnetic field contacts in a manner, which is known per se (EP 0 155 376 C1).

The contact arrangement is enclosed in a vacuum-tight housing 6, which comprises a metallic switching chamber 67, which surrounds the contact pieces, ceramic insulators 64 and 63, connected at the top, and a cover plate 61, as well as ceramic insulators 65 and 66, connected at the bottom, and a cover plate 62. Furthermore, a bellows 68, which is arranged between the current feed bolts 4 of the movable contact piece 2 and the end plate 61 is part of the housing. The housing is also joined to shields 70 and 73, which are fixed to the edges of the switching chamber 67, as well as shields 72 and 75, which are incorporated into the vacuum-tight joint between the ceramic insulator 63 and the end plate 61 and between the end plate 62 and the ceramic insulator 66 respectively and, finally, shields 71 and 74, which are fixed to ring-shaped metal pieces 76, 77, which are arranged between two mutually adjacent ceramic insulators in each case.

The mutually adjacent parts of the housing are soldered to one another and to the two current feed bolts in a vacuum-tight manner.

The vapor shields 70 to 75 each have a cylindrical shape and have folded edges. The vapor shields, which, in each case, are associated with two ceramic insulators, are arranged in an axially staggered manner so that gaps A1 and A2 are produced between them.

A switching travel S is provided for the movable contact piece 2 and, for a vacuum switch tube for 72 kV, is about 40 mm.

The ceramic insulators 63 to 66 have the same diameter D2 and, in the exemplary embodiment shown, are also the same length as one another. They can, however, also be of different lengths.—In comparison to the outside diameter D1 of the contact pieces, the inside diameter D2 of the ceramic insulators is less than the outside diameter D1 of the contact pieces plus the switching travel S.—The inside diameter D3 of the switching chamber 67 does not need to be greater than the outside diameter D1 of the contact pieces plus twice the switching travel S.

As a result of the cylindrical shape of the vapor shields and the use of a bellied switching chamber, an overall very slim tube is produced, which has a relatively small physical volume and can, because of this, be evacuated without a great deal of effort. At the same time, the metal parts and ceramic insulators forming the housing can be designed and arranged so that all the soldered joints relating to the housing of the vacuum switch chambers are made in one operation, whereby it is possible to dispense with the use of a pump stem for the evacuation of the tube. This has a positive effect on the dielectric strength of the tube.

What is claimed is:

1. A vacuum switch tube with a housing, comprising:

two contact pieces in the form of axial magnetic field contacts, which are axially movable relative to one another through a specified switching travel and are each provided with a current feed bolt;

a first ceramic insulator and a second ceramic insulator of the same diameter arranged coaxially thereto, each ceramic insulator surrounding a respective current feed bolt and the two ceramic insulators being joined to one another in a vacuum-tight manner at the end by a respective metal piece inserted therebetween in the form of a switching chamber;

cylindrical vapor shields being fixed to the inserted metal piece and the inside diameter of the ceramic insulators being less than an inside diameter of the switching chamber, wherein the first and the second ceramic insulator each has an associated ceramic insulator coaxial and adjacent thereto, the adjacent ceramic insulators each being joined to one another in a vacuum-tight manner by the respective metal piece inserted therebetween; and at least one of the cylindrical vapor shields is fixed to one of the inserted metal pieces, and the vapor shields are arranged at an axial distance from one another.

2. The vacuum switch tube as claimed in claim 1, wherein the inside diameter of the ceramic insulators is at most equal to the outside diameter of the contact pieces plus the switching travel.

3. The vacuum switch tube as claimed in claim 1, wherein the inside diameter of the metal piece, which is in the form of a switching chamber, is at most equal to the outside diameter of the contact pieces plus twice the switching travel.

4. The vacuum switch tube as claimed in claim 1, wherein the inside diameter of the metal piece, which is in the form of a switching chamber, is at most equal to the outside diameter of the contact pieces plus twice the switching travel.

5. A vacuum switch tube with a housing, comprising:

two contact pieces in the form of axial magnetic field contacts, which are axially movable relative to one another through a specified switching travel and are each provided with a current feed bolt;

a first ceramic insulator and a second ceramic insulator of the same diameter arranged coaxially thereto, each ceramic insulator surrounding a respective current feed bolt and the two ceramic insulators being joined to one another in a vacuum-tight manner at the end by a respective metal piece inserted therebetween in the form of a switching chamber;

cylindrical vapor shields being fixed to the inserted metal piece and the inside diameter of the ceramic insulators being less than an inside diameter of the switching chamber, wherein the first and the second ceramic insulator each has an associated ceramic insulator coaxial and adjacent thereto, the adjacent ceramic insulators each being joined to one another in a vacuum-tight manner by the respective metal piece inserted therebetween; and at least one of the cylindrical vapor shields is fixed to one of the inserted metal pieces, and the vapor shields are arranged staggered at an axial distance from one another.

6. A vacuum switch tube with a housing, comprising:

two contact pieces in the form of axial magnetic field contacts, which are axially movable relative to one another through a specified switching travel and are each provided with a current feed bolt;

a first ceramic insulator and a second ceramic insulator of the same diameter arranged coaxially thereto, each ceramic insulator surrounding a respective current feed bolt and the two ceramic insulators being joined to one another in a vacuum-tight manner at the end by a respective metal piece inserted therebetween in the form of a switching chamber;

cylindrical vapor shields being fixed to the inserted metal piece and the outer diameter of the ceramic insulators being less than an inner diameter of the switching chamber, wherein the first and the second ceramic insulator each has an associated ceramic insulator coaxial and adjacent thereto, the adjacent ceramic insulators each being joined to one another in a vacuum-tight manner by the respective metal piece inserted therebetween; and at least one of the cylindrical vapor shields is fixed to one of the inserted metal pieces, and the vapor shields are arranged at an axial distance from one another.

7. A vacuum switch tube with a housing, comprising:

two contact pieces in the form of axial magnetic field contacts, which are axially movable relative to one another through a specified switching travel and are each provided with a current feed bolt;

a first ceramic insulator and a second ceramic insulator of the same diameter arranged coaxially thereto, each ceramic insulator surrounding a respective current feed bolt and the two ceramic insulators being joined to one another in a vacuum-tight manner at the end by a respective metal piece inserted therebetween in the form of a switching chamber;

cylindrical vapor shields being fixed to the inserted metal piece and the inside diameter of the ceramic insulators being less than an inside diameter of the switching chamber, wherein the first and the second ceramic insulator each has an associated ceramic insulator coaxial and adjacent thereto, the adjacent ceramic insulators each being joined to one another in a vacuum-tight manner by the respective metal piece inserted therebetween; and at least one of the cylindrical vapor shields is fixed to one of the inserted metal pieces, and the vapor shields are non-overlapping and are arranged at an axial distance from one another.

8. The vacuum switch tube as claimed in claim 1, wherein the contact pieces are cup shaped to generate a magnetic field between the contact pieces.

9. A vacuum switch tube with a housing, comprising:

two contact pieces in the form of axial magnetic field contacts, which are axially movable relative to one another through a specified switching travel and are each provided with a current feed bolt;

a first ceramic insulator and a second ceramic insulator of the same diameter arranged coaxially thereto, each ceramic insulator surrounding a respective current feed bolt and the two ceramic insulators being joined to one another in a vacuum-tight manner at the end by a respective metal piece inserted therebetween in the form of a switching chamber;

cylindrical vapor shields being fixed to the inserted metal piece and the inside diameter of the ceramic insulators being less than an inside diameter of the switching chamber, wherein the first and the second ceramic insulator each has an associated ceramic insulator coaxial and adjacent thereto, the adjacent ceramic insulators each being joined to one another in a vacuum-tight manner by the respective metal piece inserted therebetween; and at least one of the cylindrical vapor shields is fixed to one of the inserted metal pieces, the vapor shields are non-overlapping and are arranged at an axial distance from one another, and a diameter measuring an inside of the ceramic insulators are greater than or equal to a diameter measuring outside diameters of the ceramic insulators.

* * * * *